US009842673B2

(12) United States Patent
Wagner et al.

(10) Patent No.: US 9,842,673 B2
(45) Date of Patent: Dec. 12, 2017

(54) COMPOSITE HIGH PERFORMANCE CABLES

(71) Applicants: Paul J Wagner, Eagan, MN (US); Thomas C. Welty, Big Lake, MN (US)

(72) Inventors: Paul J Wagner, Eagan, MN (US); Thomas C. Welty, Big Lake, MN (US)

(73) Assignee: Minnesota Wire and Cable, St. Paul, MN (US)

( * ) Notice: Subject to any disclaimer, the term of this patent is extended or adjusted under 35 U.S.C. 154(b) by 0 days.

(21) Appl. No.: 15/183,520

(22) Filed: Jun. 15, 2016

(65) Prior Publication Data

US 2016/0365176 A1 Dec. 15, 2016

Related U.S. Application Data

(60) Provisional application No. 62/175,814, filed on Jun. 15, 2015.

(51) Int. Cl.
*H01B 11/18* (2006.01)

(52) U.S. Cl.
CPC ..... *H01B 11/1808* (2013.01); *H01B 11/1817* (2013.01)

(58) Field of Classification Search
USPC ..... 174/106 R
See application file for complete search history.

(56) References Cited

U.S. PATENT DOCUMENTS 3,758,353 A * 9/1973 Huriez ..... B29C 63/42 156/52
4,301,428 A * 11/1981 Mayer ..... H01B 7/0054 174/36
5,475,185 A * 12/1995 Tokarsky ..... H01B 11/1813 174/107
9,093,195 B1 * 7/2015 Kummer ..... H01B 7/185
2002/0097966 A1 * 7/2002 Zelesnik ..... F16L 9/19 385/100
2004/0166408 A1 * 8/2004 Anderson ..... H01B 7/00 429/218.1
2011/0280527 A1 * 11/2011 Tamura ..... G02B 6/4416 385/101
2015/0050515 A1 * 2/2015 Gamba ..... A62B 35/0068 428/608

FOREIGN PATENT DOCUMENTS

JP 1092230 A * 4/1988

* cited by examiner

*Primary Examiner* — William H Mayo, III
*Assistant Examiner* — Krystal Robinson
(74) *Attorney, Agent, or Firm* — Duft Bornsen & Fettig LLP; Gregory T. Fettig

(57) ABSTRACT

In one embodiment, a cable includes a conductive core and a dielectric material surrounding the conductive core along a length of the cable. The cable also includes a first shielding comprising braided tinned copper and a second shielding comprising aramid fibers having nickel physical vapor deposited thereon. The aramid fibers are braided about the first shielding to surround a majority of the first shielding along the length of the cable.

9 Claims, 5 Drawing Sheets

COMPOSITE HIGH PERFORMANCE CABLES

CROSS REFERENCE TO RELATED APPLICATIONS

This patent application claims priority to, and thus the benefit of an earlier filing date from, U.S. Provisional Patent Application No. 62/175,814 (filed Jun. 15, 2015), the entire contents of which are hereby incorporated by reference.

BACKGROUND

Many conventional coaxial cables use braided copper wire to form a shield that isolates the cable from external electromagnetic radiation. The shielding also prevents leakage from the cable. The braided copper wire allows the cable to be flexible, but it also results in gaps in the shield layer that allow leakage and interference from external electromagnetic radiation. And, the inner dimension of the shield varies slightly because the braid cannot be flat. For better shield performance, some cables have a double-layer shield. This type of shielding may consist of two braids, but it is also common to have a thin metal foil shield covered by a copper wire braid. These shield designs often sacrifice flexibility for better performance and vice versa.

Additionally, these types of shieldings result in a cable with substantial weight. Heavier cables significantly increase transportation costs. For example, aircraft rely on many cables to carry a myriad of signals. Other forms of communication, such as radio frequency, simply cannot be used due to safety concerns. And, every pound of cable weight used on the aircraft increases the amount of fuel required to fly the aircraft. Similarly, heavier cables for ground use increase the fuel used by trucks to transport and lay the cable.

SUMMARY

In one embodiment, a cable includes a conductive core and a dielectric material surrounding the conductive core along a length of the cable. The cable also includes a first shielding comprising braided tinned copper and a second shielding comprising aramid fibers having nickel physical vapor deposited thereon. The aramid fibers are braided about the first shielding to surround a majority of the first shielding along the length of the cable.

DETAILED DESCRIPTION

The figures and the description herein illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention and are to be construed as being without limitation to such specifically recited examples and conditions. As a result, the invention is not limited to the specific embodiments or examples described herein.

Figure 1:
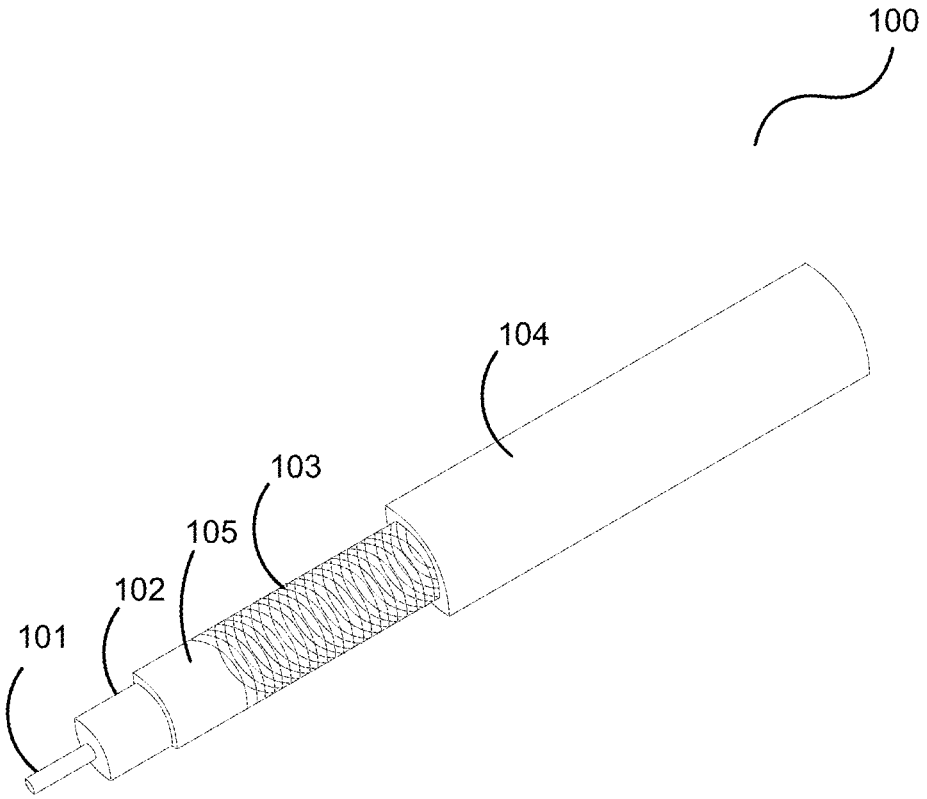
FIGS. 1 and 2 illustrate exemplary cables comprising aramid fiber shielding having physical vapor deposited nickel.

FIG. 1 is an exemplary perspective diagram of a coaxial cable 100. The coaxial cable has a conductive core 101 (e.g., copper). The core 101 is surrounded by a dielectric material 102, such as solid polyethylene (PE) or polytetrafluoroethylene. The dielectric material 102 is then surrounded with a shielding 105. The shielding 105 comprises tinned copper strands. The tinned copper strands are braided about the dielectric material 102 along the length of the cable 100 using a wire braiding machine. On top of the shielding 105 is another shielding 103 surrounding the shielding 105. The shielding 103 comprises aramid fibers that are braided about the shielding 105 along the length of the cable 100 using a textile braiding machine. The aramid fibers cover at least 80% of the shielding 105. In some instances, the fiber is selected to cover 80 to 90% of the shielding 105 for improved shielding performance.

Prior to braiding, the aramid fibers are coated with Nickel using a "dry" physical vapor deposition process. This generally results in a 30 Ohm Nickel-aramid, 400 denier material. The fibers are then spun into yarns that are fed into the fabric braiding machine. Both shieldings 103 and 105 provide electromagnetic shielding for the cable 100. But, the Nickel aramid fiber shielding 103 improves shielding performance of the cable 100. And, as the aramid fibers are not metal, per se, they dramatically decrease the overall weight of the cable. In some embodiments, the braided Nickel-aramid shielding 103 provides a weight savings of approximately 30% in total cable weight when compared to traditional double metallic braided shieldings.

Shielding performance was found to be optimal when the aramid fiber shielding 103 surrounded at least 80% of the shielding 105. Part of the difficulty in implementing the shielding 103 regards the brittle nature of the Nickel that is physical vapor deposited on the shielding 103. That is, the Nickel tends to make the aramid fibers and subject to fracturing. When spun into yarn and braided to at least 80% coverage of the braided tinned copper shielding 105, fracturing of the aramid fibers was shown to be substantially less. And, performance of the electromagnetic shielding increased well beyond levels of traditional shieldings.

Typically, once the shieldings 103 and 105 are braided onto the cable 100, a jacket 104 surrounds the length of the cable 100 for protection of the underlying components. For example, the jacket 104 may be configured from a heat shrink material that is wrapped around the cable 100. When heat is applied to the cable 100, the jacket 104 hardens and protects the underlying components from external elements. The jacket 104 also compresses the shielding 103 against the shielding 105 to "squish" or otherwise flatten the fibers of the shielding 103 so that the Nickel thereon has fewer gaps, thereby increasing the shielding performance.

As mentioned, the Ni-Aramid fibers are configured by depositing the Nickel onto the aramid fibers through a dry physical vapor deposition process. In this regard, Nickel is deposited on the aramid fibers at an atomic level. And, the physical vapor deposition of the Nickel essentially plates Nickel onto the aramid substrate. However, other fibers may be used including carbon fibers, cellulose, and jute. Jute is a relatively long, soft, shiny vegetable fiber that can be spun into coarse, strong threads. In one embodiment, the layer of Ni coated fibers are braided into a strand count of about 12,000 (e.g., 4 toes at 3,000 strands per toe), although other strand counts may be used.

Figure 2:
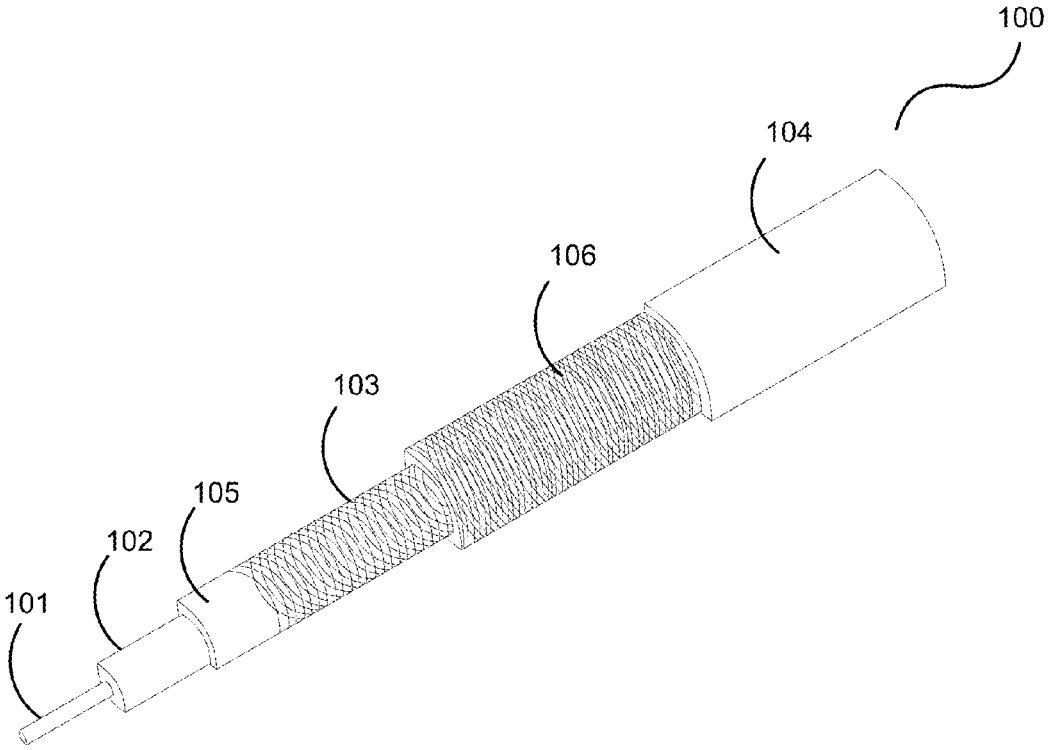

It should be noted that the invention is not intended to be limited to the exemplary embodiment as more braided Nickel-aramid fiber shieldings 103 can be used. For example, FIG. 2 illustrates another braided Nickel-aramid fiber shielding 106 that is braided about the braided Nickel-aramid fiber shielding 103. The shielding 106 is generally braided about the shielding 103 along the length of the cable 100.

Figure 3:
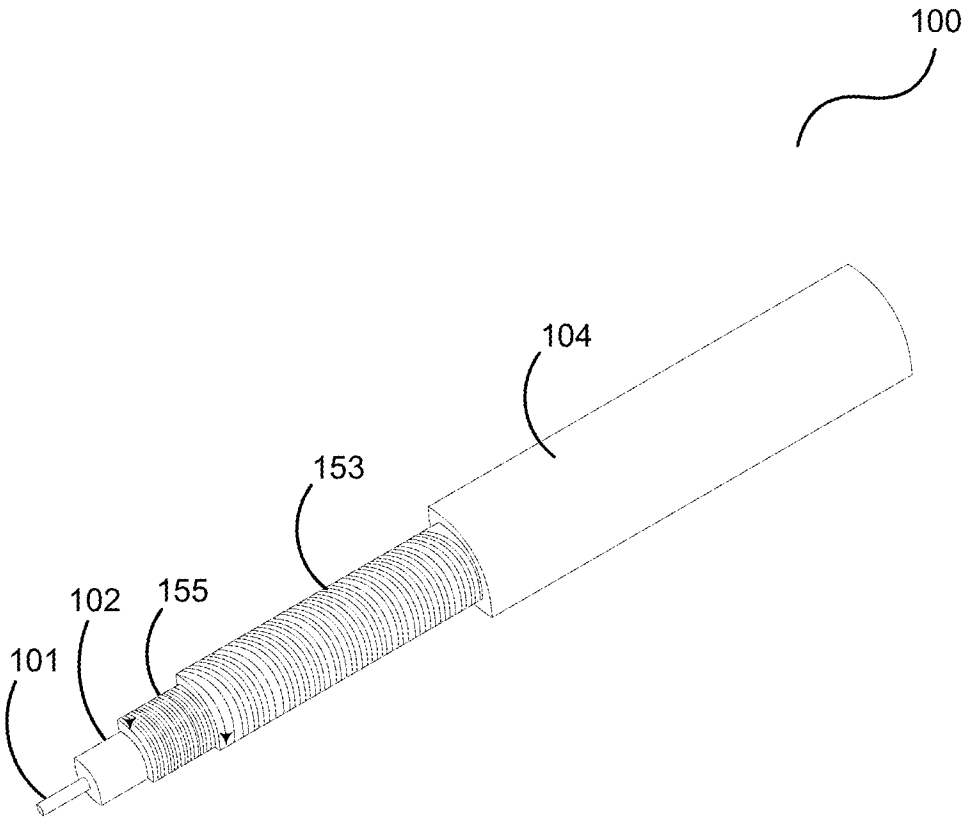
FIG. 3 illustrates another exemplary cable comprising aramid fiber shielding having physical vapor deposited nickel.

Additionally, the invention is not intended to be limited to braided shieldings. In some embodiments, the shieldings may be served (i.e., wrapped) about the cable 100. FIG. 3 illustrates another exemplary cable 100 comprising an aramid fiber shielding 153 having physical vapor deposited nickel. In this embodiment, the cable 100 again comprises a conductive core 101 and a dielectric material 102 extruded about the core 101. On top of the dielectric material 102, a tinned copper wire 155 is tightly served/wrapped in a left hand direction (a.k.a. a left-hand lay), as indicated by the arrow. And, on top of that, Nickel aramid thread 153 is served/wrapped in a right hand direction (a.k.a. a right-hand lay), as indicated by the arrow. This type of cable construction may yield similar shielding performance as the cables illustrated in FIGS. 1 and 2. But, serving the tinned copper wire and the Nickel aramid threads may implemented as a matter of design choice. In fact, the embodiments herein may be combined in various ways as a matter of design choice.

Figure 4:
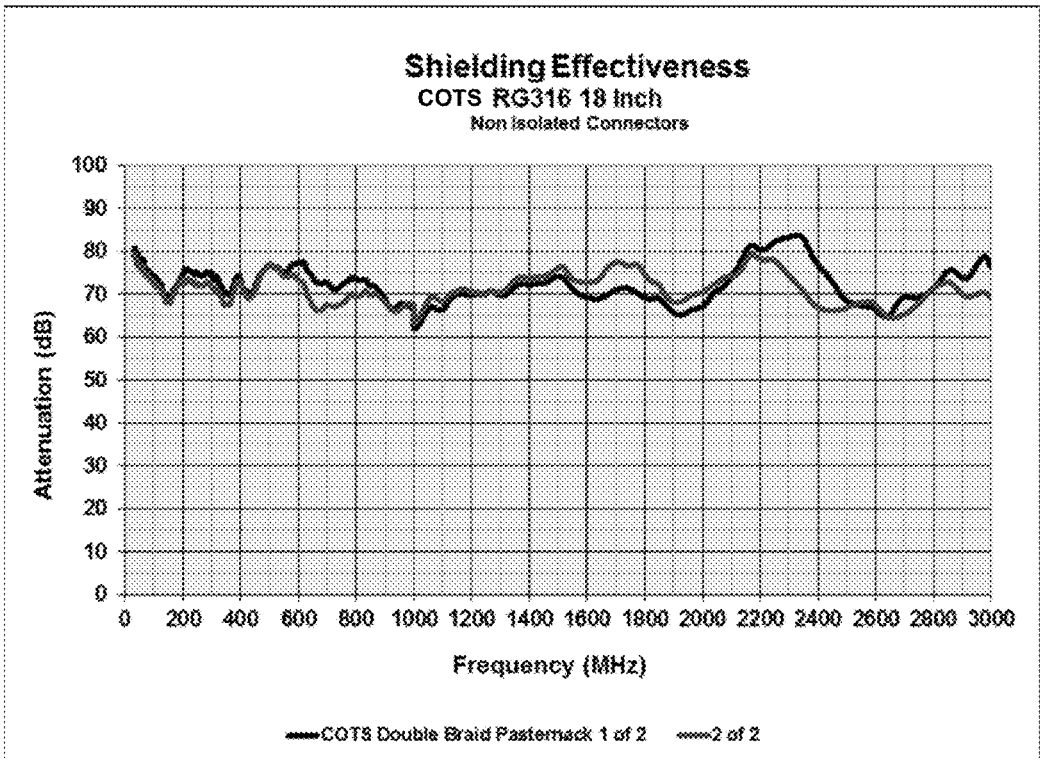
FIGS. 4 and 5 are graphs illustrating contrasting results from those achieved with traditional shielding and those achieved with the shieldings of FIGS. 1 and 2.

FIG. 4 illustrates a graph showing the shielding characteristics of a cable employing two traditional commercial off the shelf (COTS) shielding. The results of the shielding are summarized in the following table—Table 1.

TABLE 1

COTS Shielding Effectiveness Average

| Frequency Range (MHz) | Sample 1 of 2 Shielding Effectiveness (dB) | Sample 2 of 2 Shielding Effectiveness (dB) |
|---|---|---|
| 30-100 | 77 | 76 |
| 100-200 | 72 | 71 |
| 200-300 | 75 | 72 |
| 300-500 | 72 | 71 |
| 500-800 | 75 | 71 |
| 800-1000 | 69 | 68 |
| 1000-2000 | 69 | 72 |
| 2000-3000 | 74 | 71 |

Figure 5:
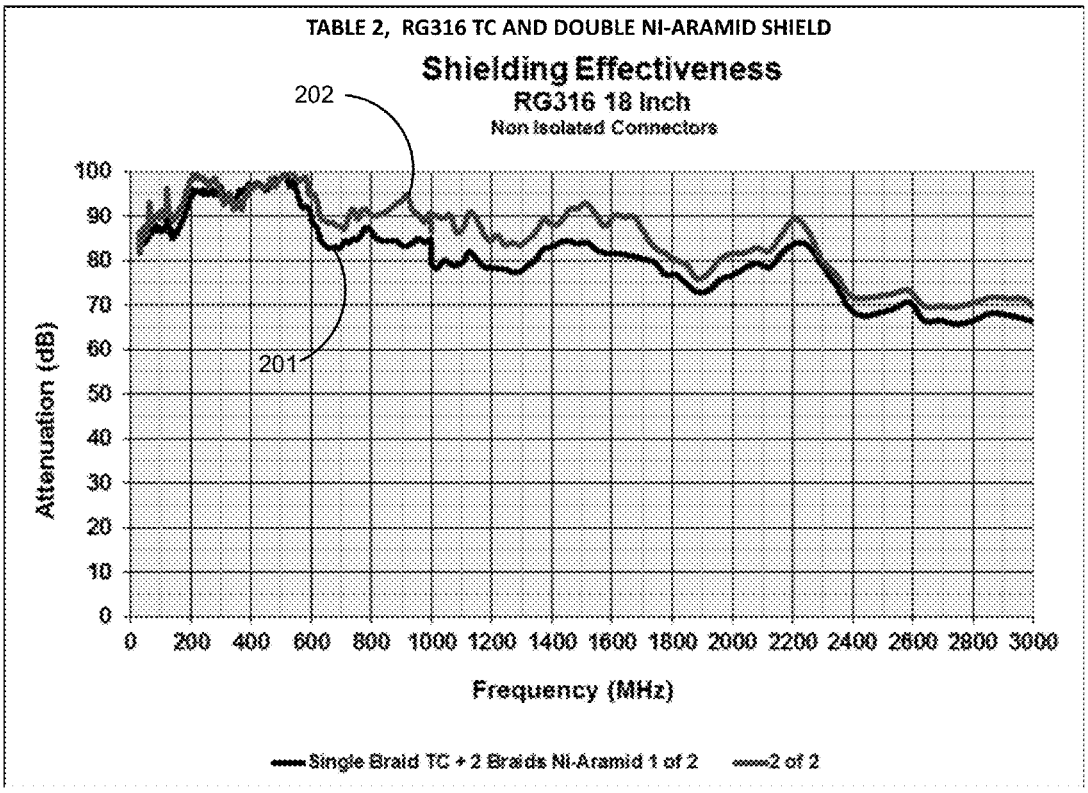

In contrast, when a single Nickel-aramid fiber shielding 103 is braided over a tinned copper braided shielding, shielding effectiveness increases dramatically. FIG. 5 illustrates a graph showing the effectiveness of two different Nickel-aramid fiber shieldings 103, a first shielding 103 braided about the tinned copper shielding 105 of the cable 100, and a second 106 braided about the shielding 103. The results 201 of the shielding 103 and the results 202 of the additional Nickel-aramid fiber 106 (summarized in Table 2 below), albeit similar, show a dramatic improvement across the frequency spectrum when compared to the results of the traditional braided shielding of Table 1. More specifically, shielding performance of the cable 100 increased significantly across the frequency spectrum tested (30-3000 MHz).

And, equally important, the weight of the cable decreased. The samples of the traditional cables had a weight of about 7.1 grams per 12 inches with an extruded jacket, whereas the braided tinned copper shielding 105 with the braided Nickel-aramid fiber shielding 103 resulted in a weight of about 3.2 grams per 12 inches with a heat shrink jacket.

TABLE 2

RG316 TC AND DOUBLE NI-ARAMID SHIELD
Shielding Effectiveness Average

| Frequency Range (MHz) | Sample 1 of 2 Shielding Effectiveness (dB) | Sample 2 of 2 Shielding Effectiveness (dB) |
|---|---|---|
| 30-100 | 85 | 87 |
| 100-200 | 88 | 92 |
| 200-300 | 95 | 98 |
| 300-500 | 96 | 95 |
| 500-800 | 89 | 93 |
| 800-1000 | 84 | 91 |
| 1000-2000 | 80 | 86 |
| 2000-3000 | 72 | 76 |

What is claimed is:

1. A cable, comprising:

a conductive core;

a dielectric material surrounding the conductive core along a length of the cable;

a first shielding comprising braided tinned copper; and a conductive second shielding comprising aramid fibers having nickel physical vapor deposited thereon, wherein the aramid fibers are braided about the first shielding to surround a majority of the first shielding along the length of the cable, and wherein a resistance of the second shielding is less than 105 Ohms.

2. The cable of claim 1, further comprising:

a heat shrink jacket surrounding the second shielding along the length of the cable, wherein the heat shrink jacket is operable to compress the first and second shieldings against the dielectric material.

3. The cable of claim 1, further comprising:

a third shielding comprising aramid fibers having nickel physical vapor deposited thereon, wherein the aramid fibers of the third shielding are braided about the second shielding to surround a majority of the second shielding along the length of the cable.

4. The cable of claim 1, wherein:

the second shielding surrounds at least eighty percent of the first shielding.

5. A cable, comprising:

a conductive core;

a dielectric material surrounding the conductive core along a length of the cable;

a first shielding comprising served tinned copper; and a conductive second shielding comprising aramid fibers having nickel physical vapor deposited thereon, wherein the aramid fibers are served about the first shielding to surround a majority of the first shielding along the length of the cable, and wherein a resistance of the second shielding is less than 105 Ohms.

6. The cable of claim 5, further comprising:

a heat shrink jacket surrounding the second shielding along the length of the cable, wherein the heat shrink jacket is operable to compress the first and second shieldings against the dielectric material.

7. The cable of claim 5, further comprising:

a third shielding comprising aramid fibers having nickel physical vapor deposited thereon, wherein the aramid fibers of the third shielding are braided or served about the second shielding to surround a majority of the second shielding along the length of the cable.

8. The cable of claim 5, wherein:

the second shielding surrounds at least eighty percent of the first shielding.

9. The cable of claim 5, wherein:

the first shielding is served in an opposite direction to the second shielding.

* * * * *